US009751312B1

(12) United States Patent
Valancy et al.

(10) Patent No.: US 9,751,312 B1
(45) Date of Patent: Sep. 5, 2017

(54) RECYCLE INK TRAY

(71) Applicant: Delta Apparel, Inc., Greenville, SC (US)

(72) Inventors: Scott Mitchell Valancy, Weston, FL (US); Andrew B. Burchfield, Pembroke Pines, FL (US)

(73) Assignee: Delta Apparel, Inc., Greenville, SC (US)

( * ) Notice: Subject to any disclaimer, the term of this patent is extended or adjusted under 35 U.S.C. 154(b) by 0 days.

(21) Appl. No.: 15/061,511

(22) Filed: Mar. 4, 2016

(51) Int. Cl.
*B41J 2/165* (2006.01)
*B41J 3/407* (2006.01)

(52) U.S. Cl.
CPC ..... *B41J 2/165* (2013.01); *B41J 3/4078* (2013.01)

(58) Field of Classification Search
CPC ..... B41J 2/165; B41J 3/4078
See application file for complete search history.

(56) References Cited

U.S. PATENT DOCUMENTS 6,860,583 B2 3/2005 Cheney et al.
8,147,049 B2 4/2012 Korol et al.
8,322,831 B2 12/2012 Bachar et al.
9,114,626 B2 8/2015 Zoltner et al.
2003/0197772 A1* 10/2003 Iwatsuki ..... B41J 11/06 347/104
2007/0285461 A1* 12/2007 Okada ..... B41J 2/16585 347/33
2013/0321540 A1* 12/2013 Platt ..... B41J 2/17593 347/89
2014/0043412 A1* 2/2014 Broderick ..... B41J 2/16523 347/90

* cited by examiner

*Primary Examiner* — Alessandro Amari
*Assistant Examiner* — Roger W Pisha, II
(74) *Attorney, Agent, or Firm* — Dority & Manning, P.A.

(57) ABSTRACT

A fabric printing device includes a printing surface for holding a fabric to be printed and an ink nozzle array movable between a print position and a standby position. The ink nozzle array is located over the printing surface when in the print position and includes a plurality of ink nozzle groups. Each ink nozzle group is configured to spray a different color ink than an adjacent ink nozzle group. The fabric printing device also includes a recycle ink tray defining a plurality of partitioned ink pools, each ink pool associated with one of the plurality of ink nozzle groups. The ink nozzle array is positioned over the recycle ink tray when in the standby position such that substantially all of the ink sprayed from a particular ink nozzle group is received in a respective partitioned ink pool and isolated from ink in an adjacent partitioned ink pool.

17 Claims, 5 Drawing Sheets

RECYCLE INK TRAY

FIELD OF THE INVENTION

The present invention relates generally to a recycle ink tray and a fabric printing device including the same.

BACKGROUND OF THE INVENTION

Printing designs and other objects on garments, such as T-shirts, sweatshirts, etc., may be accomplished using a direct to garment printing device. These direct to garment printing devices typically include a plurality of ink nozzles for printing the image onto the garment. Each of the ink nozzles may be configured to spray a single color of ink, the plurality of ink nozzles working together in concert to form the desired image on the garment.

With modern advances to garment printing devices, the plurality of ink nozzles may print relatively complex images on garments. Specifically, depending on the garment printing device, the nozzles may be relatively fine nozzles capable of spraying ink with a relatively high precision. As a consequence of the increased capability of these nozzles, the openings therein are relatively small. Accordingly, in order to ensure the nozzles do not clog up in between printing operations, or during other standby operations, garment printing devices may be configured to spray relatively small amounts of ink at certain intervals into a waste ink tray during such standby operations. Each of the plurality of nozzles sprays ink during the standby operations into the same waste ink tray. Such operations may prevent ink from drying and forming particles that may clog the nozzles.

However, operating garment printing devices in such manner may result in a relatively large amount of waste ink. Accordingly, a garment printing device capable of capturing the waste ink in a manner as to allow the waste ink to be recycled/reused would be useful.

BRIEF DESCRIPTION OF THE INVENTION

Aspects and advantages of the invention will be set forth in part in the following description, or may be obvious from the description, or may be learned through practice of the invention.

In one exemplary embodiment of the present disclosure, a fabric printing device is provided. The fabric printing device includes a printing surface for holding a fabric to be printed, and an ink nozzle array moveable between a print position and a standby position. The ink nozzle array is located over the printing surface when in the print position. The ink nozzle array includes a plurality of ink nozzle groups, each ink nozzle group configured to spray a different color ink than an adjacent ink nozzle group. The fabric printing device also includes a recycle ink tray defining a plurality of partitioned ink pools, each partitioned ink pool associated with one of the plurality of ink nozzle groups. The ink nozzle array is positioned over the recycle ink tray when in the standby position such that when the ink nozzle array is in the standby position, substantially all of the ink sprayed from a particular ink nozzle group is received in a respective partitioned ink pool and isolated from ink in an adjacent partitioned ink pool.

In another exemplary embodiment of the present disclosure, a recycle ink assembly for a fabric printing device is provided. The fabric printing device includes an ink nozzle array, the ink nozzle array including a plurality of nozzle groups. The recycle ink assembly includes a recycle ink tray comprising a perimeter wall and a plurality of partition walls. The perimeter wall and the plurality of partition walls together define a plurality of partitioned ink pools. Each partitioned ink pool is configured to collect ink from an individual ink nozzle group and prevent ink collected from the ink nozzle group from mixing with ink collected from an adjacent ink nozzle group.

In an exemplary aspect of the present disclosure a method of operating a fabric printing device is provided. The method includes providing ink of various colors to an ink nozzle array, and moving the ink nozzle array to a standby position over a recycle ink tray. The recycle ink tray defines a plurality of partitioned ink pools, each partitioned ink pool associated with an ink nozzle group of the ink nozzle array. The method also includes spraying ink from each ink nozzle group into its associated partitioned ink pool defined by the recycle ink tray such that the ink sprayed from each ink nozzle group is isolated from ink sprayed from the other ink nozzle groups.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
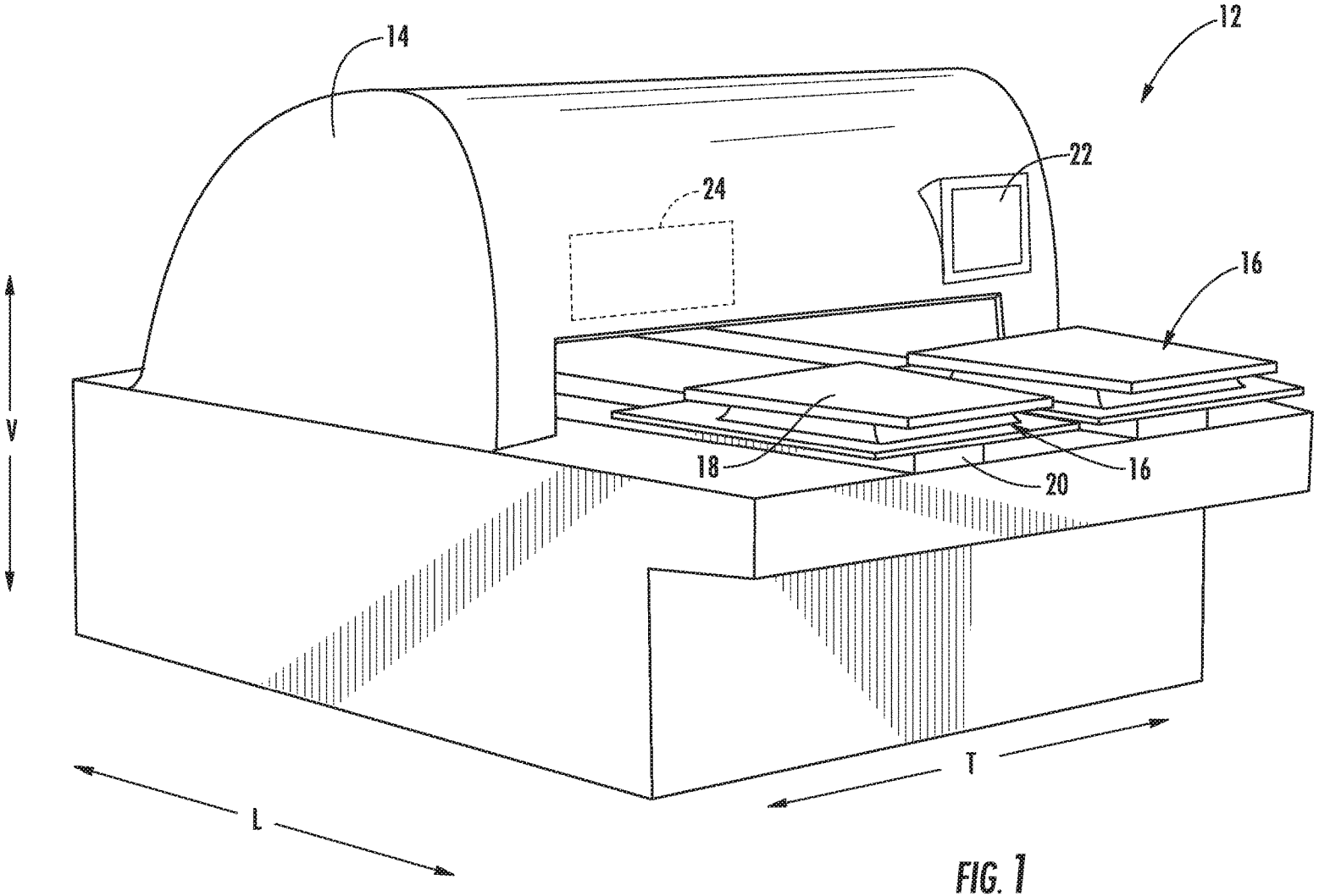
FIG. 1 is a perspective view of a fabric printing device in accordance with an exemplary aspect of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

A fabric printing device is provided herein with a recycle ink tray capable of collecting ink sprayed during standby operations (e.g., to prevent clogging of one or more nozzles of the fabric printing device), while keeping inks of a different color separated. Specifically, a recycle ink tray in accordance with one or more of the embodiments described below may define a separate, partitioned ink pool for each color of ink sprayed by a plurality of nozzles of the fabric printing device. The recycle ink tray may capture the ink, and provide such ink to separate storage containers. The captured ink may then be provided back to an ink source for the fabric printing device, such that the ink may be recycled.

Referring particularly to FIG. 1 a fabric printing device 12 in accordance with an exemplary embodiment of the present disclosure is depicted. It should be appreciated, that although a specific fabric printing device 12 is described below, in other exemplary embodiments, aspects of the present disclosure may additionally, or alternatively, be incorporated into any other suitable fabric printing device. The fabric printing device 12 defines a longitudinal direction L, a transverse direction T, and a vertical direction V, each orthogonal to one another. Additionally, the fabric printing device 12 generally includes a housing 14 and two printing slide assemblies 16. Each printing slide assembly 16 includes a printing surface 18 for holding a fabric to be printed and a track system 20. The track system 20 allows the printing surface 18 to move along the longitudinal direction L between a loading position (shown) and an interior position, i.e., a position within the housing 14 for printing. Although not depicted, the printing surface 18 may include clamps or other fasteners to hold the fabric in position during printing operations. In certain embodiments, the fabric printing device 12 may be configured to print images or other designs onto, e.g., T-shirts, sweatshirts, towels, or any other suitable fabrics.

The printing device also includes a user interface 22 through which a user may control the fabric printing device 12. For example, the user may load an image to be printed through the user interface 22, initiate printing operations, and control other parameters related to the fabric printing device 12. The user interface 22 may also provide certain information about the fabric printing device 12 to the user. For example, the user interface 22 may provide information about ink levels, or any errors received during printing operations.

As will be explained in greater detail below, the fabric printing device 12 additionally includes an ink nozzle array 24 (depicted in phantom) for spraying a design onto a fabric. More particularly, the ink nozzle array 24 includes a plurality of ink nozzles 26 (see FIGS. below) configured to spray various colored inks onto the fabric held by the printing surface 18. Accordingly, the ink nozzle array 24 may include, or alternatively may be in fluid communication with, an ink supply.

Figure 2:
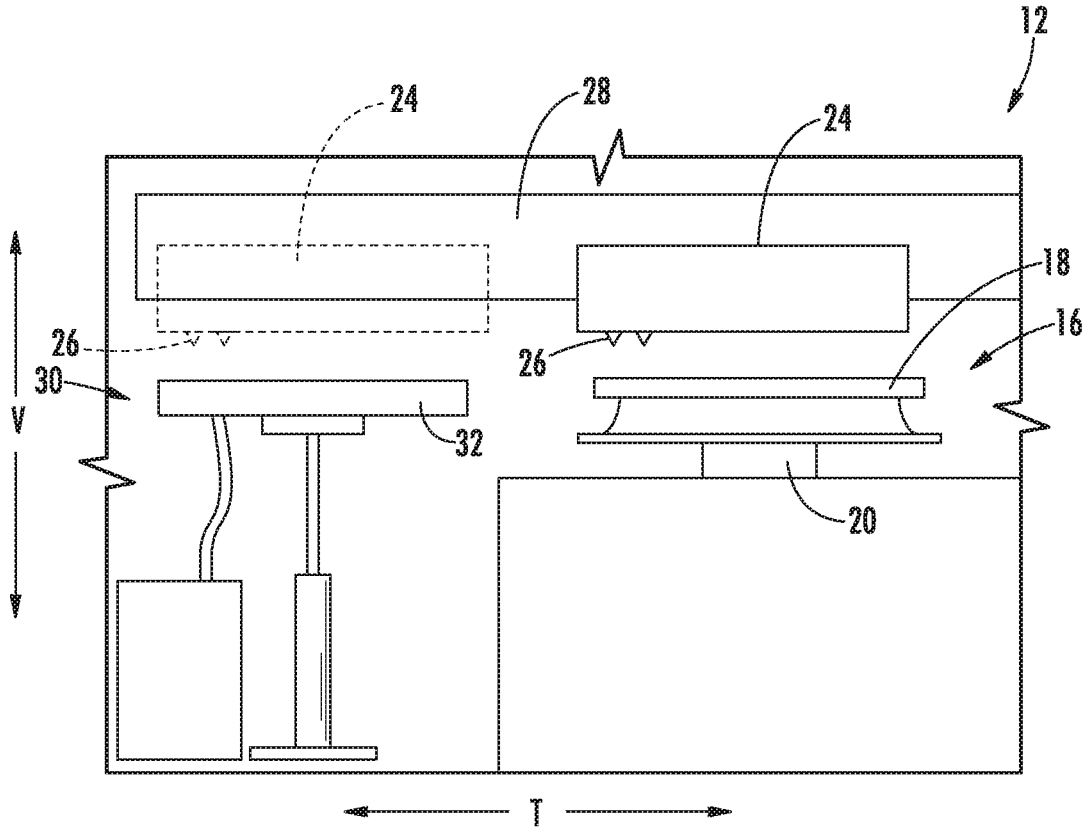
FIG. 2 is a front, schematic, cross-sectional view of a portion of the exemplary fabric printing device of FIG. 1.

Referring now to FIG. 2, a front, schematic, cross-sectional view of the exemplary fabric printing device 12 of FIG. 1 is depicted. The cross-sectional view of FIG. 2 is taken within the housing 14 of the fabric printing device 12. For the embodiment depicted the printing surface 18 is in the interior position to allow for a fabric attached to thereto to be printed on.

As stated, the fabric printing device 12 includes the ink nozzle array 24. The ink nozzle array 24 is movable between a print position (shown) and a standby position (depicted in phantom). More particularly, for the embodiment depicted, the ink nozzle array 24 is movable along the transverse direction T between the print position and the standby position. The exemplary fabric printing device 12 depicted includes a track 28 for moving the ink nozzle array 24 between the print position and the standby position. The track 28 may include one or more hydraulic and/or electric motors moving the ink nozzle array 24. As will be shown more clearly below, the ink nozzle array 24 includes a plurality of ink nozzles 26 for spraying various colored inks onto the fabric during printing operations.

During printing operations, the ink nozzle array 24 is positioned over the printing surface 18 in the print position. By contrast, however, between printing operations, the ink nozzle array 24 is moved along the transverse direction T away from the printing surface 18 to the standby position. As will be appreciated, depending on a length of time at which the ink nozzle array 24 is in the standby position, the ink nozzles 26 may spray small amounts of ink (also referred to as "spitting"). Such may prevent ink in the nozzles from drying, and the dried particles of ink from clogging the ink nozzles 26 and/or being sprayed on a fabric, decreasing a print quality on the fabric. The exemplary fabric printing device 12 additionally includes a recycle ink assembly 30 including a recycle ink tray 32 to collect the ink sprayed from the plurality of ink nozzles 26 when in the standby position.

Figure 3:
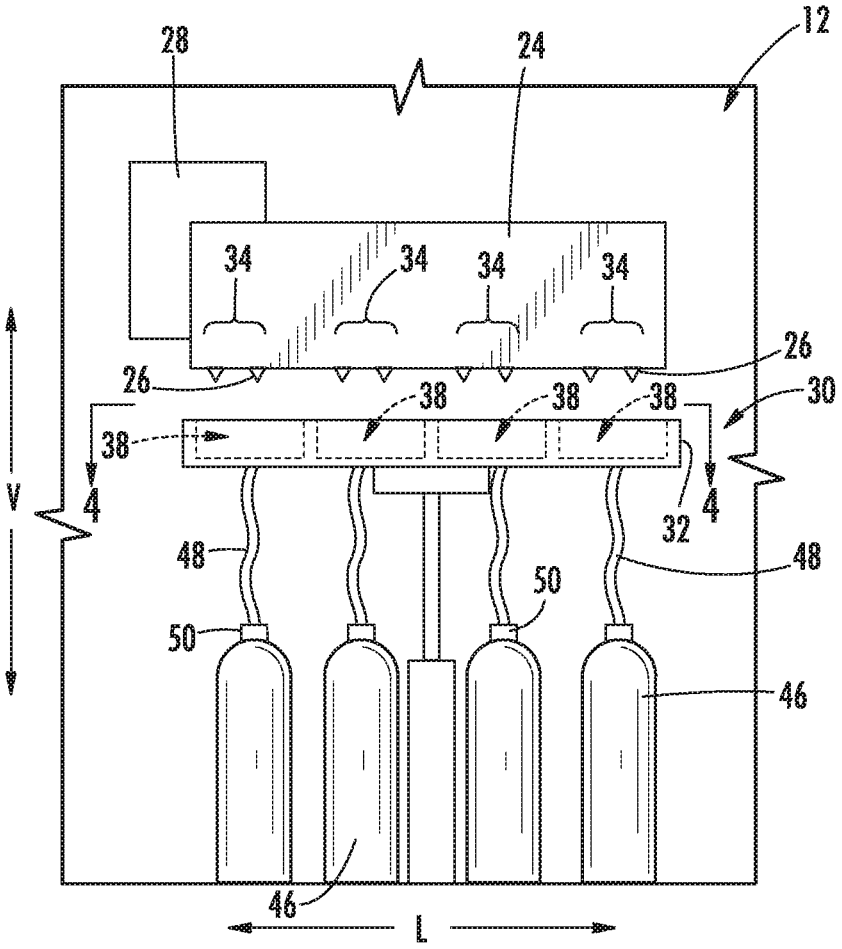
FIG. 3 is a side, schematic, cross-sectional view of the exemplary fabric printing device of FIG. 1.
Figure 4:
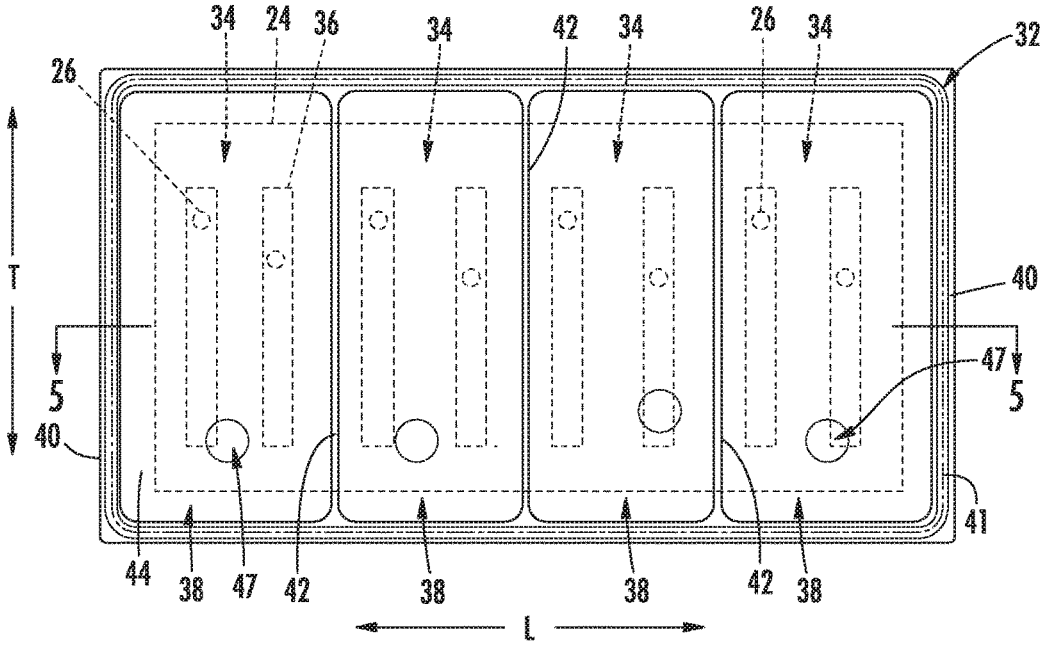
FIG. 4 is a top view of a recycle ink tray in accordance with an exemplary embodiment of the present disclosure for use in the exemplary fabric printing device of FIG. 1.

Referring now also to FIGS. 3 and 4, additional views of the ink nozzle array 24 and recycle ink tray 32 are provided. Specifically, FIG. 3 provides a schematic view of the ink nozzle array 24 in the standby position, and FIG. 4 provides a top view of the recycle ink tray 32 taken along Line 4-4 in FIG. 3, with the ink nozzle array 24 depicted in phantom for illustrative purposes.

As is depicted, the ink nozzle array 24 includes a plurality of ink nozzle groups 34. Each ink nozzle group 34 is configured to spray a different color ink than an adjacent ink nozzle group 34. In certain exemplary embodiments, the ink nozzle array 24 may include at least three ink nozzle groups 34, at least four ink nozzle groups 34, at least six ink nozzle groups 34, or any other suitable number of ink nozzle groups 34. Specifically, for the embodiment depicted, the ink nozzle array 24 includes four ink nozzle groups 34. In certain embodiments, the four ink nozzle groups 34 may be configured as a black ink nozzle group 34 for spraying black ink, cyan ink nozzle group 34 for spraying cyan ink, a magenta ink nozzle group 34 for spraying magenta ink, and a yellow ink nozzle group 34 for spraying yellow ink. However, in other exemplary embodiments, the ink nozzle groups 34 may have any other suitable color combination.

Additionally, each ink nozzle group 34 for the embodiment depicted includes one or more ink nozzles 26 configured spray the same color ink. More particularly, for the embodiment depicted, each ink nozzle group 34 includes two ink nozzles 26. However, in other embodiments, each ink nozzle group 34 may include any other suitable number of ink nozzles 26. The ink nozzles 26 within each ink nozzle group 34 may slide along a track 36 in the transverse direction T during, e.g., printing operations.

As stated, when the ink nozzle array 24 is in the standby position, the ink nozzle array 24 is positioned over the recycle ink tray 32. The recycle ink tray 32 defines a plurality of partitioned ink pools 38 configured to collect ink from an individual ink nozzle group 34. Specifically, each partitioned ink pool 38 is associated with one of the plurality of ink nozzle groups 34. For example, for the embodiment depicted, the recycle ink tray 32 defines four partitioned ink pools 38, and each of the four partitioned ink pools 38 is associated with one of the four ink nozzle groups 34, such that each ink nozzle group 34 of the ink nozzle array 24 is positioned directly above a respective partitioned ink pool 38 and is configured to spray ink into the respective partitioned ink pool 38 during standby operations. Notably, for the embodiment depicted, the printing surface 18 extends along the longitudinal direction L, the ink nozzle groups 34 are arranged along the longitudinal direction L, and the plurality of partitioned ink pools 38 are also arranged along the longitudinal direction L. However, in other embodiments, the ink nozzle groups 34 and partitioned ink pools 38 may instead be arranged along any other direction.

Figure 5:
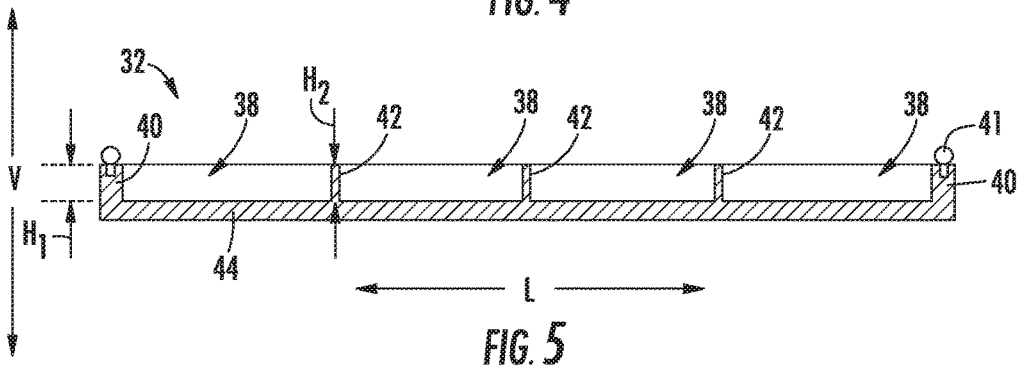
FIG. 5 is a side, cross-sectional view of the exemplary recycle ink tray of FIG. 4.

Referring now also to FIG. 5, providing a cross-sectional view of the recycle ink tray 32 along Line 5-5 in FIG. 4, the exemplary recycle ink tray 32 depicted generally includes a perimeter wall 40, a plurality of partition walls 42, and a bottom wall 44. Notably, for the embodiment depicted, a top side of the perimeter wall 40 includes a gasket 41 attached thereto for interfacing with the ink nozzle array 24. The gasket 41 may be formed of any suitable elastomeric material. Additionally, the perimeter wall 40, the plurality of partition walls 42, and the bottom wall 44 define the plurality of partitioned ink pools 38. For the embodiment depicted the perimeter wall 40 defines a height H1 along the vertical direction V relative to the bottom wall 44, and similarly, each of the partition walls 42 also defines a height H2 along the vertical direction V relative to the bottom wall 44. The height H2 of the partition walls 42 is substantially the same as the height H1 of the perimeter wall 40. It should be appreciated, that as used herein, terms of approximation, such as "substantially," refer to being within a five percent (5%) margin of error.

With such a configuration, when ink is sprayed through the plurality of ink nozzles 26 of the various ink nozzle groups 34, substantially all of the ink sprayed from a particular ink nozzle group 34 is received in a respective partitioned ink pool 38 and isolated from ink in an adjacent partitioned ink pool 38. Specifically, each partitioned ink pool 38 may be configured to receive ink from an associated ink nozzle group 34 and prevent the received ink from mixing with ink received in an adjacent partitioned ink pool 38 from a different ink nozzle group 34. Accordingly, such a configuration may keep ink of different colors from mixing with one another in the recycle ink tray 32.

Notably, for the embodiment depicted, the recycle ink assembly 30 additionally includes a plurality of recycle ink storage containers 46. Each recycle ink storage container 46 is fluidly connected to one of the partitioned ink pools 38 defined by the recycle ink tray 32. More specifically, each recycle ink storage container 46 is fluidly connected with one of the partitioned ink pools 38 through a dedicated fluid line 48 attached to an opening 47 defined in the bottom wall 44 at the partitioned ink pool 38. Accordingly, a partitioned ink pool 38 defined by the recycle ink tray 32 may collect ink from a respective ink nozzle group 34, and provide such ink to a respective storage container 46 through a respective fluid line 48.

For the embodiment depicted, the recycle ink assembly 30 additionally includes a filter for filtering particles out of ink flowing therethrough. The filter may be a micron sized filter. Specifically, the filter may be a forty micron or less filter, a thirty micron or less filter, a twenty micron or less filter, a fifteen micron or less filter, or any other suitable sized filter. Specifically, for the embodiment depicted, the recycle ink assembly 30 includes a plurality of filters 50. Each filter 50 is arranged in-line with one of the dedicated fluid lines 48 for filtering particles out of ink flowing therethrough. More particularly, the recycle ink assembly 30 includes a plurality of filters 50 attached between the dedicated fluid lines 48 and the recycle ink storage containers 46. The plurality of filters 50 may prevent any dried particles of ink from entering the recycle ink storage containers 46.

A fabric printing device in accordance with one more embodiments of the present disclosure may allow for more efficient recycling of waste ink during operation of the fabric printing device. More particularly, a fabric printing device in accordance with one or more embodiments of the present disclosure may capture waste ink sprayed by the various ink nozzle groups in such a manner as to keep different color inks separate from one another such that the inks may be captured, stored, and reused. Such a configuration may result in more economical printing operations.

It should be appreciated, however, that in other exemplary embodiments, the fabric printing device 12 may have any other suitable configuration and the recycle ink assembly 30 may be configured in any other suitable manner. For example, in other embodiments, the partitioned ink pools 38 may have any other suitable shape and may be formed in any other suitable manner. Additionally, although the exemplary recycle ink assembly 30 includes filters 50 in-line with the dedicated fluid lines 48, in other embodiments, the recycle ink assembly 30 may not include the filters, and instead the recycled ink may be filtered separately, prior to being reused.

Figure 6:
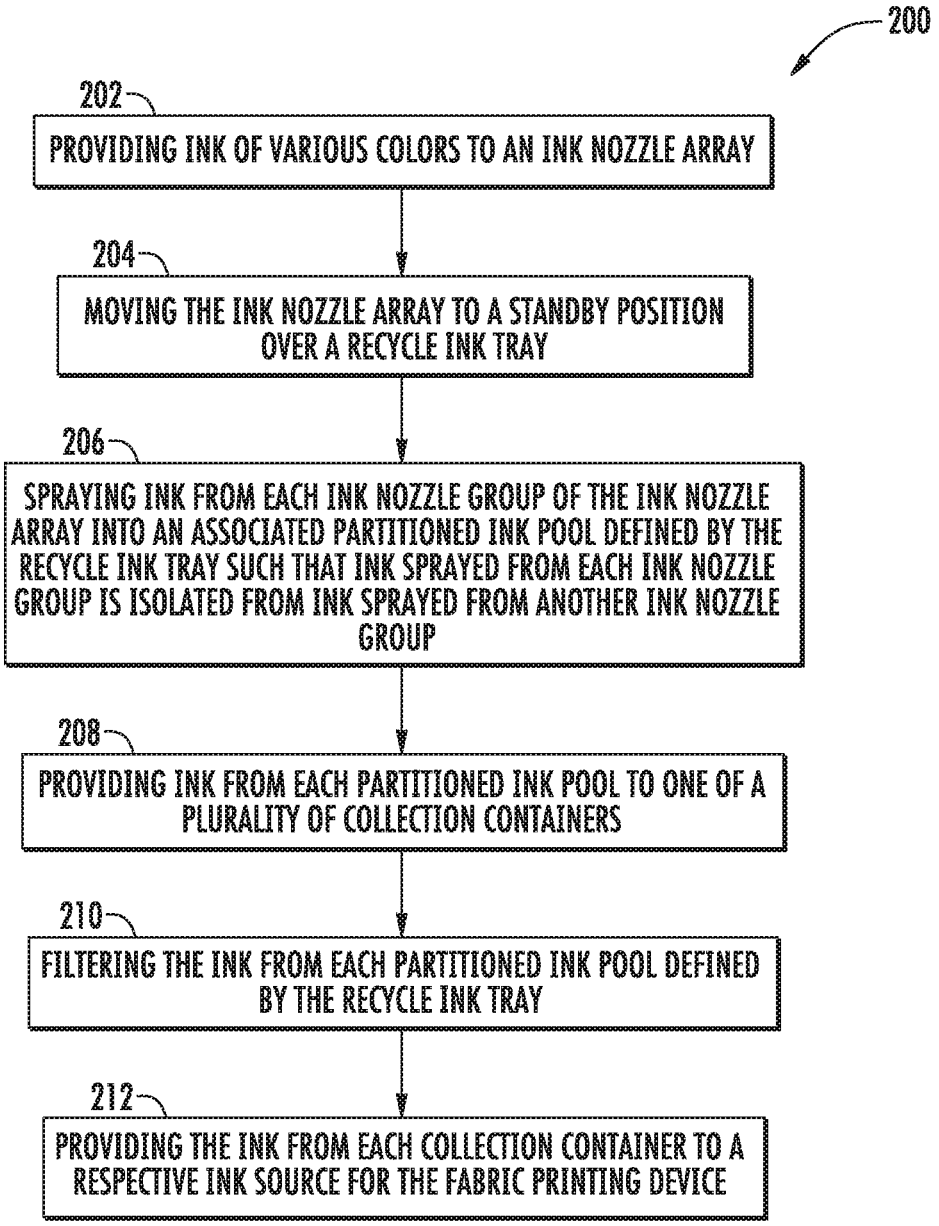
FIG. 6 is a flow diagram of a method of operating a fabric printing device in accordance with an exemplary aspect of the present disclosure.

Referring now to FIG. 6, a flow diagram of a method (200) for operating a fabric printing device in accordance with an exemplary aspect of the present disclosure is provided. In certain exemplary aspects, the exemplary method (200) may be utilized with the exemplary fabric printing device 12 described above with reference to FIGS. 1 through 5.

The exemplary method (200) includes at (202) providing ink of various colors to an ink nozzle array. The exemplary method (200) additionally includes at (204) moving the ink nozzle array to a standby position over a recycle ink tray. The recycle ink tray defines a plurality of partitioned ink pools, each partitioned ink pool associated with an ink nozzle group of the recycle ink tray. The exemplary method also includes at (206) spraying ink from each ink nozzle group into its associated partitioned ink pool defined by the recycle ink tray such that ink sprayed from each ink nozzle group is isolated from ink sprayed from the other ink nozzle groups.

The exemplary method (200) additionally includes at (208) providing ink from each partitioned ink pool to one of a plurality of collection containers. Each collection container is dedicated to one of the partitioned ink pools defined by the recycle ink tray. In certain exemplary aspects, providing at (208) ink from each partitioned ink pool to one of a plurality of collection containers may include providing such ink through a dedicated fluid line.

The exemplary method (200) additionally includes at (210) filtering the ink from each partitioned ink pool defined by the recycle ink tray. Filtering the ink from each partitioned ink pool defined by the recycle ink tray at (210) may include filtering the ink in-line with one or more dedicated fluid lines providing the ink from each partitioned ink pool to the respective collection containers. Additionally, the exemplary method (200) includes at (212) providing the ink from each collection container to a respective ink source for the fabric printing device.

It should be appreciated, however, that in other exemplary aspects, the exemplary method (200) may include any other suitable steps. For example in other exemplary aspects, filtering the ink from each partitioned ink pool at (210) may include filtering the ink after the ink has been collected in a respective collection container at (208) and before such ink is provided back to an ink source of the fabric printing device at (212).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fabric printing device comprising:

a printing surface for holding a fabric to be printed;

an ink nozzle array moveable between a print position and a standby position, the ink nozzle array located over the printing surface when in the print position, the ink nozzle array comprising a plurality of ink nozzle groups, each ink nozzle group configured to spray a different color ink than an adjacent ink nozzle group;

a recycle ink tray defining a plurality of partitioned ink pools, each partitioned ink pool associated with one of the plurality of ink nozzle groups, the ink nozzle array positioned over the recycle ink tray when in the standby position such that when the ink nozzle array is in the standby position substantially all of the ink sprayed from a particular ink nozzle group is received in a respective partitioned ink pool and isolated from ink in an adjacent partitioned ink pool;

a plurality of recycle ink storage containers, wherein each recycle ink storage container is fluidly connected to one of the partitioned ink pools defined by the recycle ink tray through a dedicated fluid line; and a plurality of filters, each filter arranged in-line with one of the dedicated fluid lines for filtering particles out of ink flowing therethrough.

2. The fabric printing device of claim 1, wherein when the nozzle array is in the standby position each ink nozzle group of the ink nozzle array is positioned directly above a respective partitioned ink pool and is configured to spray ink into the respective partitioned ink pool.

3. The fabric printing device of claim 1, wherein the printing surface extends along a longitudinal direction, wherein the nozzle groups are arranged along the longitudinal direction, and wherein the plurality of partitioned ink pools are also arranged along the longitudinal direction.

4. The fabric printing device of claim 1, wherein the recycle ink tray comprises an outer perimeter wall and a plurality of partition walls defining the plurality of partitioned ink pools.

5. The fabric printing device of claim 4, wherein the recycle ink tray further comprises a bottom wall, wherein the outer perimeter wall defines a height relative to the bottom wall, wherein the plurality of partition walls define a height relative to the bottom wall, and wherein the height of the outer perimeter wall is substantially the same as the height of the plurality of partition walls.

6. The fabric printing device of claim 1, wherein the plurality of ink nozzle groups includes at least four ink nozzle groups, and wherein the recycle ink tray defines at least four partitioned ink pools.

7. The fabric printing device of claim 1, wherein each nozzle group comprises two or more nozzles, each configured to spray a same colored ink.

8. The fabric printing device of claim 1, wherein each of the plurality of filters is a forty micron or less filter.

9. The fabric printing device of claim 1, wherein each of the plurality of filters is a fifteen micron or less filter.

10. The fabric printing device of claim 1, wherein the recycle ink tray comprises an outer perimeter wall and a gasket attached to a top side of the outer perimeter wall for interfacing with the ink nozzle array.

11. The fabric printing device of claim 1, wherein each of the plurality of filters is positioned proximate a respective recycle ink storage container.

12. The fabric printing device of claim 11, wherein each of the plurality of filters is positioned at a downstream end of the respective dedicated fluid line.

13. A recycle ink assembly for a fabric printing device, the fabric printing device comprising an ink nozzle array, the ink nozzle array comprising a plurality of nozzle groups, the recycle ink assembly comprising:

a recycle ink tray comprising a perimeter wall and a plurality of partition walls, the perimeter wall and the plurality of partition walls together defining a plurality of partitioned ink pools, each partitioned ink pool configured to collect ink from an individual ink nozzle group and prevent ink collected from the ink nozzle group from mixing with ink collected from an adjacent ink nozzle group;

a plurality of recycle ink storage containers, wherein each recycle ink storage container is fluidly connected to one of the partitioned ink pools defined by the recycle ink tray through a dedicated fluid line; and a plurality of filters, each filter arranged in-line with one of the dedicated fluid lines for filtering particles out of ink flowing therethrough.

14. The recycle ink assembly of claim 13, wherein the recycle ink tray further comprises a bottom wall, wherein the outer perimeter wall defines a height relative to the bottom wall, wherein the plurality of partition walls define a height relative to the bottom wall, and wherein the height of the outer perimeter wall is substantially the same as the height of the plurality of partition walls.

15. The recycle ink assembly of claim 13, wherein the recycle ink tray defines at least four partitioned ink pools.

16. A method of operating a fabric printing device comprising:

providing ink of various colors to an ink nozzle array;

moving the ink nozzle array to a standby position over a recycle ink tray, the recycle ink tray defining a plurality of partitioned ink pools, each partitioned ink pool associated with an ink nozzle group of the ink nozzle array;

spraying ink from each ink nozzle group into its associated partitioned ink pool defined by the recycle ink tray such that the ink sprayed from each ink nozzle group is isolated from ink sprayed from the other ink nozzle groups;

providing ink from each partitioned ink pool to one of a plurality of collection containers, each collection container dedicated to one of the partitioned ink pools defined by the recycle ink tray; and providing ink collected in each of the collection containers to an ink source of the fabric printing device.

17. The method of claim 16, further comprising:

filtering the ink from each partitioned ink pool defined by the recycle ink tray.

* * * * *